US007375274B2

(12) United States Patent
Hiratsuka

(10) Patent No.: US 7,375,274 B2
(45) Date of Patent: May 20, 2008

(54) AUTOMATIC ACCOMPANIMENT APPARATUS, METHOD OF CONTROLLING THE APPARATUS, AND PROGRAM FOR IMPLEMENTING THE METHOD

(75) Inventor: Satoshi Hiratsuka, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 353 days.

(21) Appl. No.: 11/282,203

(22) Filed: Nov. 17, 2005

(65) Prior Publication Data

US 2006/0107825 A1 May 25, 2006

(30) Foreign Application Priority Data

Nov. 19, 2004 (JP) ..... 2004-336072

(51) Int. Cl.
*G10H 7/00* (2006.01)

(52) U.S. Cl. ..... 84/622; 84/601; 84/609

(58) Field of Classification Search ..... 84/622, 84/601, 609

See application file for complete search history.

(56) References Cited

U.S. PATENT DOCUMENTS 4,682,526 A * 7/1987 Hall et al. ..... 84/613
5,300,727 A * 4/1994 Osuga et al. ..... 84/622
5,420,374 A * 5/1995 Hotta ..... 84/622
5,506,370 A * 4/1996 Nakai et al. ..... 84/637
5,656,790 A * 8/1997 Adachi ..... 84/601
5,696,343 A * 12/1997 Nakata ..... 84/609
5,850,051 A * 12/1998 Machover et al. ..... 84/634
5,864,081 A * 1/1999 Iwase et al. ..... 84/622
5,898,118 A * 4/1999 Tamura ..... 84/602
5,920,025 A * 7/1999 Itoh et al. ..... 84/611
6,069,311 A 5/2000 Hiramatsu et al.
6,184,453 B1 * 2/2001 Izumisawa ..... 84/604
6,232,541 B1 * 5/2001 Kumagai ..... 84/645
6,919,502 B1 * 7/2005 Yamamoto ..... 84/622
7,129,407 B2 * 10/2006 Hiratsuka et al. ..... 84/609
7,312,390 B2 * 12/2007 Yanagawa et al. ..... 84/615
2002/0112596 A1 * 8/2002 Kondo ..... 84/609

(Continued)

FOREIGN PATENT DOCUMENTS

JP 61-292691 12/1986

(Continued)

*Primary Examiner*—Lincoln Donovan
*Assistant Examiner*—Christina Russell
(74) *Attorney, Agent, or Firm*—Morrison & Foerster LLP

(57) ABSTRACT

An automatic accompaniment apparatus that enables an external electronic musical instrument connected thereto to exhibit its accompaniment information generating capability to the maximum and makes it possible to set tone color data and accompaniment data adapted to the external electronic musical instrument through the automatic accompaniment apparatus. The external electronic musical instrument stores in advance a plurality of tone color data and/or a plurality of accompaniment data and generates accompaniment information based on the selected tone color data and/or accompaniment data. List information on the stored tone color data and/or the accompaniment data is acquired via a control interface that connects to the external electronic musical instrument and carries out transmission and reception of information to and from the external electronic musical instrument, and the acquired list information is presented to a user. Control information for causing the external electronic musical instrument to set tone color data and/or accompaniment data selected by the user from the presented list information is transmitted to the external electronic musical instrument via the control interface.

12 Claims, 11 Drawing Sheets

U.S. PATENT DOCUMENTS

| | | | | |
|---|---|---|---|---|
| 2003/0131712 | A1* | 7/2003 | Torimura | 84/477 R |
| 2003/0172799 | A1* | 9/2003 | Sakurai et al. | 84/622 |
| 2004/0055442 | A1* | 3/2004 | Terada | 84/601 |
| 2004/0094020 | A1* | 5/2004 | Wang et al. | 84/622 |
| 2004/0267791 | A1* | 12/2004 | Sunako | 707/100 |
| 2006/0054008 | A1* | 3/2006 | Yanase et al. | 84/622 |
| 2007/0068368 | A1* | 3/2007 | Hiramastu et al. | 84/609 |

FOREIGN PATENT DOCUMENTS

| | | |
|---|---|---|
| JP | 07-168563 | 7/1995 |
| JP | 08-234732 | 9/1996 |
| JP | 10-319952 | 12/1998 |

* cited by examiner

FIG. 6A

LIST OF TONE COLOR DATA IN MODEL THAT HAS ONLY SMALL NUMBER OF (128) TONE COLORS

| TONE COLOR DESIGNATION INFORMATION | | TONE COLOR NAME |
|---|---|---|
| BANK SELECT NUMBER | PROGRAM CHANGE NUMBER | |
| 1 | 1 | Acoustic Grand Piano |
| 1 | 2 | Bright Acoustic Piano |
| ⋮ | ⋮ | ⋮ |
| 1 | 128 | Gunshot |

FIG. 6B

LIST OF TONE COLOR DATA IN MODEL THAT HAS MANY (384) TONE COLORS

| TONE COLOR DESIGNATION INFORMATION | | TONE COLOR NAME |
|---|---|---|
| BANK SELECT NUMBER | PROGRAM CHANGE NUMBER | |
| 1 | 1 | Acoustic Grand Piano |
| 1 | 2 | Bright Acoustic Piano |
| ⋮ | ⋮ | ⋮ |
| 1 | 128 | Gunshot |
| 2 | 1 | Acoustic Grand Piano A |
| 2 | 2 | Bright Acoustic Piano A |
| ⋮ | ⋮ | ⋮ |
| 2 | 128 | Gunshot A |
| 3 | 1 | Acoustic Grand Piano B |
| 3 | 2 | Bright Acoustic Piano B |
| ⋮ | ⋮ | ⋮ |
| 3 | 128 | Gunshot B |

FIG. 7A

LIST OF TONE COLOR DATA IN MODEL THAT HAS ONLY FOUR ACCOMPANIMENT STYLES

| ACCOMPANIMENT DESIGNATION INFORMATION | | ACCOMPANIMENT NAME |
|---|---|---|
| CATEGORY NUMBER | STYLE NUMBER | |
| 1 | 1 | Bossanova |
| 2 | 1 | English Walts |
| 3 | 1 | 16 Beat Shuffle |
| 3 | 2 | 8 Beat |

FIG. 7B

LIST OF TONE COLOR DATA IN MODEL THAT HAS MANY ACCOMPANIMENT STYLES

| ACCOMPANIMENT DESIGNATION INFORMATION | | ACCOMPANIMENT NAME |
|---|---|---|
| CATEGORY NUMBER | STYLE NUMBER | |
| 1 | 1 | Bossanova |
| 1 | 2 | Cha Cha Cha |
| 1 | 3 | Mambo |
| 1 | 4 | Samba |
| ⋮ | ⋮ | ⋮ |
| 2 | 1 | English Walts |
| 2 | 2 | Country Walts |
| 2 | 3 | Jazz Walts |
| ⋮ | ⋮ | ⋮ |
| 3 | 1 | 16 Beat Shuffle |
| 3 | 2 | 8 Beat |
| ⋮ | ⋮ | ⋮ |

AUTOMATIC ACCOMPANIMENT APPARATUS, METHOD OF CONTROLLING THE APPARATUS, AND PROGRAM FOR IMPLEMENTING THE METHOD

BACKGROUND OF THE INVENTION

1. Field of the Invention

The present invention relates to an automatic accompaniment apparatus and a method of controlling the same that connect an external electronic musical instrument to the apparatus and generate accompaniments via the external electronic musical instrument, as well as a program for implementing the method.

2. Description of the Related Art

Conventionally, there has been known an automatic accompaniment apparatus that connects an external electronic musical instrument thereto and generates accompaniments via the external electronic musical instrument.

As an example of such an automatic accompaniment apparatus, there has been proposed an automatic accompaniment apparatus that connects thereto a musical tone generating apparatus (electronic musical instrument), which does not have an automatic accompaniment function, and generates an accompaniment via the musical tone generating apparatus by transmitting accompaniment information generated by the automatic accompaniment apparatus to the musical tone generating apparatus (see Japanese Laid-Open Patent Publication (Kokai) No. S61-292691, for example).

In the above conventional automatic accompaniment apparatus, however, accompaniment information is generated by the automatic accompaniment apparatus whereas accompaniment tones are sounded by the external electronic musical instrument. Thus, not accompaniment data stored in the external electronic musical instrument but accompaniment data stored in the automatic accompaniment apparatus is used as accompaniment data (for example, accompaniment style data) in generating accompaniment information. Therefore, even if accompaniment data stored in the external electronic musical instrument is musically richer than accompaniment data stored in the automatic accompaniment apparatus, accompaniment information is generated using the accompaniment data stored in the automatic accompaniment apparatus, and hence the generated accompaniment information thus generated does not enable the external electronic musical instrument to exhibit its accompaniment information generating capability to the maximum.

Also, in the above conventional automatic accompaniment apparatus, even if an external electronic musical instrument connected thereto is capable of generating accompaniment information, what kind of tone color data and accompaniment data are stored in advance in the external electronic musical instrument cannot be known through the automatic accompaniment apparatus, and hence tone color data and accompaniment data adapted to the external electronic musical instrument cannot be set through the automatic accompaniment apparatus.

SUMMARY OF THE INVENTION

It is an object of the present invention to provide an automatic accompaniment apparatus and a method of controlling the same that enable an external electronic musical instrument connected to the apparatus to exhibit its accompaniment information generating capability to the maximum and make it possible to set tone color data and accompaniment data adapted to the external electronic musical instrument through the automatic accompaniment apparatus, as well as a program for implementing the method.

To attain the above object, in a first aspect of the present invention, there is provided an automatic accompaniment apparatus comprising a connecting device that connects to an external electronic musical instrument that stores in advance at least one of a plurality of tone color data and a plurality of accompaniment data and generates accompaniment information based on at least one of tone color data and accompaniment data selected from the stored at least one of the plurality of tone color data and the plurality of accompaniment data, and carries out transmission and reception of information to and from the external electronic musical instrument, a list information acquiring device that acquires list information on the at least one of tone color data and accompaniment data stored in the external electronic musical instrument via the connecting device, a presenting device that presents the list information acquired by the list information acquiring device to a user, and a transmitting device that transmits control information for causing the external electronic musical instrument to set at least one of tone color data and accompaniment data selected by the user from the list information presented by the presenting device to the external electronic musical instrument via the connecting device.

With the arrangement of the automatic accompaniment apparatus according to the first aspect of the present invention, list information on at least one of tone color data and accompaniment data stored in the external electronic musical instrument is acquired via the connecting device, the acquired list information is presented to the user, and control information for causing the external electronic musical instrument to set at least one of tone color data and accompaniment data selected by the user from the presented list information is transmitted to the external electronic musical instrument via the connecting device. As a result, the external electronic musical instrument can exhibit its accompaniment information generating capability to the maximum, and it is possible to set at least one of tone color data and accompaniment data adapted to the external electronic musical instrument through the automatic accompaniment apparatus.

To attain the above object, in a second aspect of the present invention, there is provided an automatic accompaniment apparatus comprising a storage device that stores sets of list information, each set of which is concerned with at least one of a plurality of tone color data and a plurality of accompaniment data stored in advance in a corresponding one of a plurality of electronic musical instruments, so as to correspond to respective ones of the electronic musical instruments, a connecting device that connects to an external electronic musical instrument that stores in advance at least one of a plurality of tone color data and a plurality of accompaniment data and generates accompaniment information based on at least one of tone color data and accompaniment data selected from the stored at least one of the plurality of tone color data and the plurality of accompaniment data, and carries out transmission and reception of information to and from the external electronic musical instrument, an apparatus information acquiring device that acquires apparatus information on the external electronic musical instrument via the connecting device, a presenting device that reads out list information corresponding to the apparatus information acquired by the apparatus information acquiring device from the storage device and presents the list information to a user, and a transmitting device that transmits control information for causing the external electronic musical instrument to set at least one of tone color data and accompaniment data selected by the user from the list information presented by the presenting device to the external electronic musical instrument via the connecting device.

With the arrangement of the automatic accompaniment apparatus according to the second aspect of the present invention, apparatus information on the external electronic musical instrument is acquired via the connecting device, list information corresponding to the acquired apparatus information is read out from the storage device and presented to the user, and control information for causing the external electronic musical instrument to set at least one of tone color data and accompaniment data selected by the user from the presented list information is transmitted to the external electronic musical instrument via the connecting device. As a result, the external electronic musical instrument can exhibit its accompaniment information generating capability to the maximum, and it is possible to set at least one of tone color data and accompaniment data adapted to the external electronic musical instrument through the automatic accompaniment apparatus.

Preferably, the automatic accompaniment apparatus further comprises a list information acquiring device operable when the list information corresponding to the apparatus information acquired by the apparatus information acquiring device is not stored in the storage device, to acquire the list information from outside including from the external electronic musical instrument.

More preferably, the storage device comprises a nonvolatile storage device and stores the list information acquired by the list information acquiring device.

With the more preferable arrangement of the automatic accompaniment apparatus according to the second aspect of the present invention, the storage device is a nonvolatile one, and the acquired list information is stored in the storage device. Thus, when the same external electronic musical instrument as the external electronic musical instrument about which the list information has been stored is connected to the automatic accompaniment apparatus next time, it is only necessary to read out the list information stored in the storage device without performing processing for acquiring list information. As a result, quick use of list information can be ensured.

To attain the above object, in a third aspect of the present invention, there is provided an automatic accompaniment apparatus comprising a reproducing device that reproduces music data including at least one of tone color designation data and accompaniment designation data, a connecting device that connects to an external electronic musical instrument that stores in advance at least one of a plurality of tone color data and a plurality of accompaniment data and generates accompaniment information based on at least one of tone color data and accompaniment data selected from the stored at least one of the plurality of tone color data and the plurality of accompaniment data, and carries out transmission and reception of information to and from the external electronic musical instrument, a list information acquiring device that acquires list information on the at least one of tone color data and accompaniment data stored in the external electronic musical instrument via the connecting device, a selecting device that automatically selects at least one of tone color data and accompaniment data closest to the at least one of tone color designation data and accompaniment designation data included in the music data reproduced by the reproducing device from the list information acquired by the list information acquiring device, a transmitting device that transmits control information for causing the external electronic musical instrument to set the at least one of tone color data and accompaniment data selected by the selecting device to the external electronic musical instrument via the connecting device, and a control device that controls the external electronic musical instrument such that accompaniment information on the music data reproduced by the reproducing device is generated based on the set at least one of tone color data and accompaniment data.

With the arrangement of the automatic accompaniment apparatus according to the third aspect of the present invention, list information on at least one of tone color data and accompaniment data stored in the external electronic musical instrument is acquired via the connecting device, at least one of tone color data and accompaniment data closest to at least one of tone color designation data and accompaniment designation data included in reproduced music data is automatically selected from the acquired list information, control information for causing the external electronic musical instrument to set the selected at least one of tone color data and accompaniment data is transmitted to the external electronic musical instrument via the connecting device, and the external electronic musical instrument is controlled such that accompaniment information on the reproduced music data is generated based on the set at least one of the set tone color data and accompaniment data. As a result, the external electronic musical instrument can exhibit its accompaniment information generating capability to the maximum, and it is possible to set at least one of tone color data and accompaniment data adapted to the external electronic musical instrument through the automatic accompaniment apparatus. Also, even in the case where at least one of tone color data and accompaniment data that completely corresponds to at least one of tone color designation data and accompaniment data included in the reproduced music data is not included in the acquired list information, at least one of tone color data and accompaniment data close thereto is automatically selected, and as a result, errors in setting at least one of tone color data and accompaniment data can be eliminated in the external electronic musical instrument.

To attain the above object, in a fourth aspect of the present invention, there is provided an automatic accompaniment apparatus comprising, a reproducing device that reproduces music data including at least one of tone color designation data and accompaniment designation data, a storage device that stores sets of list information, each set of which is concerned with at least one of a plurality of tone color data and a plurality of accompaniment data stored in advance in a corresponding one of a plurality of electronic musical instruments, so as to correspond to respective ones of the electronic musical instruments, a connecting device that connects to an external electronic musical instrument that stores in advance at least one of a plurality of tone color data and a plurality of accompaniment data and generates accompaniment information based on at least one of tone color data and accompaniment data selected from the stored at least one of the plurality of tone color data and the plurality of accompaniment data, and carries out transmission and reception of information to and from the external electronic musical instrument, an apparatus information acquiring device that acquires apparatus information on the external electronic musical instrument via the connecting device, a readout device that reads out list information corresponding to the apparatus information acquired by the apparatus information acquiring device from the storage device, a selecting device that automatically selects at least one of tone color data and accompaniment data closest to the at least one of tone color designation data and accompaniment designation data included in the music data reproduced by the reproducing device from the list information acquired by the list information acquiring device, a transmitting device that transmits control information for causing the external electronic musical instrument to set the at least one of tone color data and accompaniment data selected by the selecting device to the external electronic musical instrument via the connecting device, and a control device that controls the external electronic musical instrument such that accompaniment information on the music data reproduced by the reproducing device is generated based on the set at least one of tone color data and accompaniment data.

With the arrangement of the automatic accompaniment apparatus according to the fourth aspect of the present invention, apparatus information on the external electronic musical instrument is acquired via the connecting device, list information corresponding to the acquired apparatus information is read out from the storage device, at least one of tone color data and accompaniment data closest to at least one of tone color designation data and accompaniment designation data included in the reproduced music data is automatically selected from the acquired list information, control information for causing the external electronic musical instrument to set the selected at least one of tone color data and accompaniment data is transmitted to the external electronic musical instrument via the connecting device, and the external electronic musical instrument is controlled so that accompaniment information on the reproduced music data is reproduced based on the set at least one of tone color data and accompaniment data. As a result, the external electronic musical instrument can exhibit its accompaniment information generating capability to the maximum, and it is possible to set at least one of tone color data and accompaniment data adapted to the external electronic musical instrument through the automatic accompaniment apparatus. Also, even in the case where at least one of tone color data and accompaniment data that completely corresponds to at least one of tone color designation data and accompaniment data included in the reproduced music data is not included in the acquired list information, at least one of tone color data and accompaniment data close thereto is automatically selected, and as a result, errors in setting at least one of tone color data and accompaniment data can be eliminated in the external electronic musical instrument.

Preferably, the automatic accompaniment apparatus further comprises a list information acquiring device operable when the list information corresponding to the apparatus information acquired by the apparatus information acquiring device is not stored in the storage device, to acquire the list information from outside including from the external electronic musical instrument.

More preferably, the storage device comprises a nonvolatile storage device and stores the list information acquired by the list information acquiring device.

To attain the above object, in a fifth aspect of the present invention, there is provided a method of controlling an automatic accompaniment apparatus, comprising, an apparatus information acquiring step of acquiring apparatus information on an external electronic musical instrument that stores in advance at least one of a plurality of tone color data and a plurality of accompaniment data and generates accompaniment information based on at least one of tone color data and accompaniment data selected from the stored at least one of the plurality of tone color data and the plurality of accompaniment data via a connecting device that connects to the external electronic musical instrument and carries out transmission and reception of information to and from the external electronic musical instrument, a presenting step of reading out list information corresponding to the apparatus information acquired in the apparatus information acquiring step from a storage device that stores sets of list information, each set of which is concerned with at least one of a plurality of tone color data and a plurality of accompaniment data stored in advance in a corresponding one of a plurality of electronic musical instruments, so as to correspond to respective ones of the electronic musical instruments, and presenting the list information to a user, and a transmitting step of transmitting control information for causing the external electronic musical instrument to set at least one of tone color data and accompaniment data selected by the user from the list information presented in the presenting step to the external electronic musical instrument via the connecting device.

According to the fifth aspect of the present invention, the same effects as those obtained by the automatic accompaniment apparatus according to the second aspect can be obtained.

To attain the above object, in a sixth aspect of the present invention, there is provided a method of controlling an automatic accompaniment apparatus, comprising a reproducing step of reproducing music data including at least one of tone color designation data and accompaniment designation data, an apparatus information acquiring step of acquiring apparatus information on an external electronic musical instrument that stores in advance at least one of a plurality of tone color data and a plurality of accompaniment data and generates accompaniment information based on at least one of tone color data and accompaniment data selected from the stored at least one of the plurality of tone color data and the plurality of accompaniment data via a connecting device that connects to the external electronic musical instrument and carries out transmission and reception of information to and from the external electronic musical instrument, a readout step of reading out list information corresponding to the apparatus information acquired in the apparatus information acquiring step from a storage device that stores sets of list information, each set of which is concerned with at least one of a plurality of tone color data and a plurality of accompaniment data stored in advance in a corresponding one of a plurality of electronic musical instruments, so as to correspond to respective ones of the electronic musical instruments, a selecting step of automatically selecting at least one of tone color data and accompaniment data closest to the at least one of tone color designation data and accompaniment designation data included in the music data reproduced in the reproducing step from the list information read out in the readout step, a transmitting step of transmitting control information for causing the external electronic musical instrument to set the at least one of tone color data and accompaniment data selected in the selecting step to the external electronic musical instrument via the connecting device, and a control step of controlling the external electronic musical instrument such that accompaniment information on the music data reproduced in the reproducing step is generated based on the set at least one of tone color data and accompaniment data.

According to the sixth aspect of the present invention, the same effects as those obtained by the automatic accompaniment apparatus according to the third aspect can be obtained.

To attain the above object, in a seventh aspect of the present invention, there is provided a program for causing a computer to execute a method of controlling an automatic accompaniment apparatus, comprising an apparatus information acquiring module for acquiring apparatus information on an external electronic musical instrument that stores in advance at least one of a plurality of tone color data and a plurality of accompaniment data and generates accompaniment information based on at least one of tone color data and accompaniment data selected from the stored at least one of the plurality of tone color data and the plurality of accompaniment data via a connecting device that connects to the external electronic musical instrument and carries out transmission and reception of information to and from the external electronic musical instrument, a presenting module for reading out list information corresponding to the apparatus information acquired by the apparatus information acquiring module from a storage device that stores sets of list information, each set of which is concerned with at least one of a plurality of tone color data and a plurality of accompaniment data stored in advance in a corresponding one of a plurality of electronic musical instruments, so as to correspond to respective ones of the electronic musical instruments, and presenting the list information to a user, and a transmitting module for transmitting control information for causing the external electronic musical instrument to set at least one of tone color data and accompaniment data selected by the user from the list information presented by the presenting module to the external electronic musical instrument via the connecting device.

According to the seventh aspect of the present invention, the same effects as those obtained by the automatic accompaniment apparatus according to the second aspect can be obtained.

To attain the above object, in an eighth aspect of the present invention, there is provided a program for causing a computer to execute a method of controlling an automatic accompaniment apparatus, comprising a reproducing module for reproducing music data including at least one of tone color designation data and accompaniment designation data, an apparatus information acquiring module for acquiring apparatus information on an external electronic musical instrument that stores in advance at least one of a plurality of tone color data and a plurality of accompaniment data and generates accompaniment information based on at least one of tone color data and accompaniment data selected from the stored at least one of the plurality of tone color data and the plurality of accompaniment data via a connecting device that connects to the external electronic musical instrument and carries out transmission and reception of information to and from the external electronic musical instrument, a readout module for reading out list information corresponding to the apparatus information acquired by the apparatus information acquiring module from a storage device that stores sets of list information, each set of which is concerned with at least one of a plurality of tone color data and a plurality of accompaniment data stored in advance in a corresponding one of a plurality of electronic musical instruments, so as to correspond to respective ones of the electronic musical instruments, a selecting module for automatically selecting at least one of tone color data and accompaniment data closest to the at least one of tone color designation data and accompaniment designation data included in the music data reproduced by the reproducing module from the list information read out by the readout module, a transmitting module for transmitting control information for causing the external electronic musical instrument to set the at least one of tone color data and accompaniment data selected by the selecting module to the external electronic musical instrument via the connecting device, and a control module for controlling the external electronic musical instrument such that accompaniment information on the music data reproduced by the reproducing module is generated based on the set at least one of tone color data and accompaniment data.

According to the eighth aspect of the present invention, the same effects as those obtained by the automatic accompaniment apparatus according to the third aspect can be obtained.

The above and other objects, features, and advantages of the invention will become more apparent from the following detained description taken in conjunction with the accompanying drawings.

BRIEF DESCRIPTION OF THE DRAWINGS

FIGS. 6A and 6B are diagrams showing examples of views of list information on tone color data acquired from two models of external electronic musical instruments differing in the numbers of pieces of tone color data they hold, in which FIG. 6A shows an example of view of list information acquired from the model that holds only a small number of (e.g. 128) pieces of tone color data, and FIG. 6B shows an example of view of list information acquired from the model that holds a large number of (e.g. 384) pieces of tone color data;

FIGS. 7A and 7B are diagrams showing examples of views of accompaniment data list information acquired from two models of external electronic musical instruments differing in the numbers of pieces of accompaniment data they hold, in which FIG. 7A shows an example of view of list information acquired from the model that holds only a small number of pieces (e.g. 4 kinds) of accompaniment data, and FIG. 7B shows an example of view of list information acquired from the model that holds a large number of pieces of accompaniment data;

DETAILED DESCRIPTION OF THE PREFERRED EMBODIMENTS

The present invention will now be described in detail with reference to the drawings showing preferred embodiments thereof.

Figure 1:
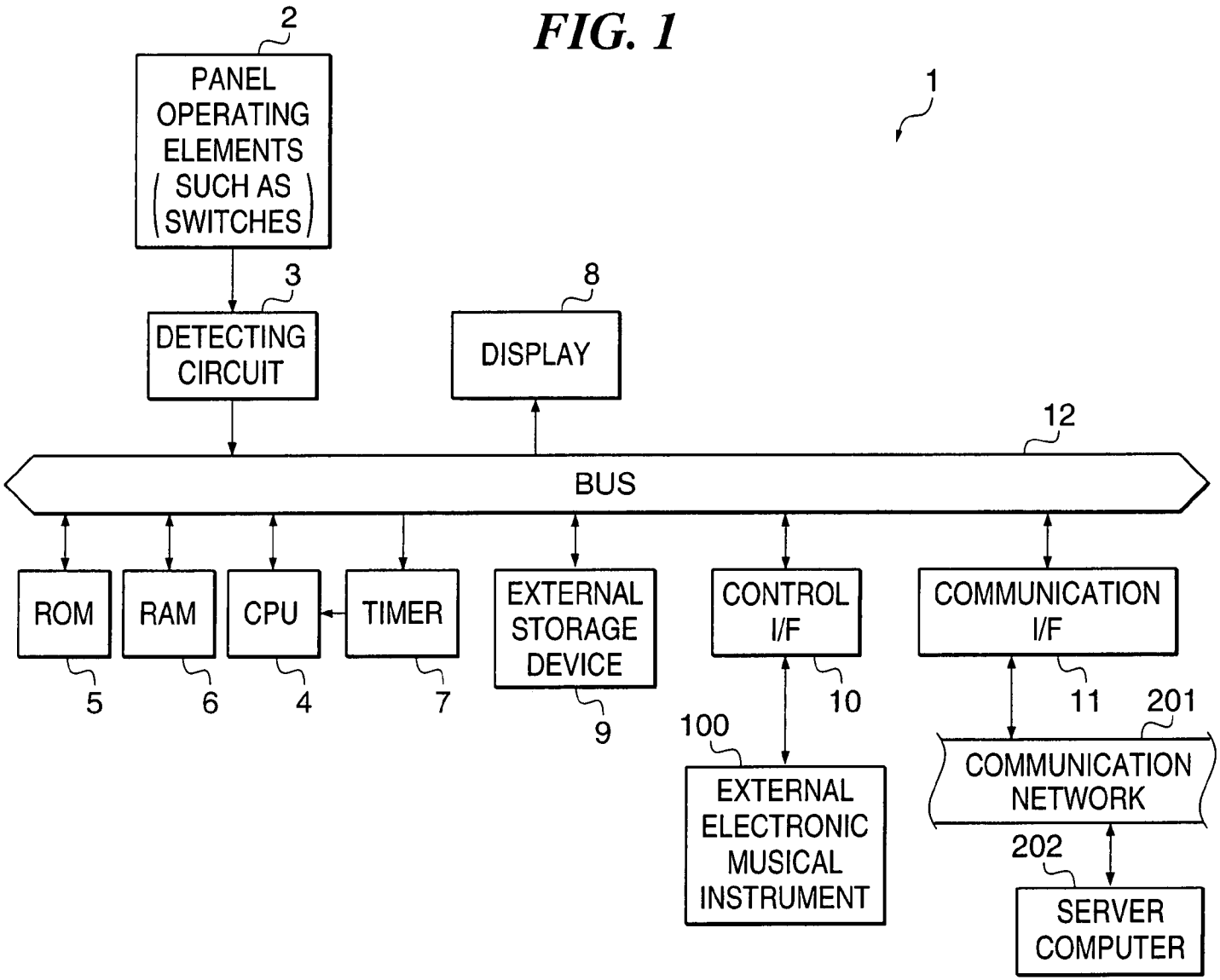
FIG. 1 is a block diagram schematically showing the construction of an automatic accompaniment apparatus according to a first embodiment of the present invention.

FIG. 1 is a block diagram schematically showing the construction of an automatic accompaniment apparatus 1 according to a first embodiment of the present invention.

As shown in FIG. 1, the automatic accompaniment apparatus 1 is comprised of panel operating elements 2 including a plurality of switches and a numeric keypad for inputting various information; a detecting circuit 3 for detecting operative states of the panel operating elements 2; a CPU 4 that controls the entire apparatus; a ROM 5 that stores control programs executed by the CPU 4, various table data, etc.; a RAM 6 for temporarily storing accompaniment information, various input information, computation results, etc.; a timer 7 that measures an interrupt time for timer interrupt processing and various kinds of time; a display 8 comprised of a liquid crystal display (LCD), light emitting diodes (LEDs), etc., for displaying various information; an external storage device 9 that stores various application programs including control programs, various musical composition data, and various other data; a control interface (I/F) 10 that inputs control information from external devices and outputs control information to external devices; and a communication interface (I/F) 11 that performs transmission and reception of data to and from, for example, a server computer (hereinafter simply referred to as "the server") 202 via a communication network 201.

The above component elements 3 to 11 are connected to one another via a bus 12. The timer 7 is connected to the CPU 4, an external electronic musical instrument 100 to the control I/F 10, and the communication network 201 to the communication I/F 11, respectively. Here, the communication I/F 11 and the communication network 201 should not necessarily be wired, but may be wireless. Alternatively, one may be wired and the other may be wireless.

The external storage device 9 may be implemented, for example, by a flexible disk drive (FDD), a hard disk drive (HDD), a CD-ROM drive, or a magneto-optical disk drive (MO). The external storage device 9 may store the control programs to be executed by the CPU 4 as mentioned above. If one or more of the control programs are not stored in the ROM 5, the control program(s) may be stored in the external storage device 9, and by reading out the control program(s) from the external storage device 9 and storing the same in the RAM 6, the CPU 4 can operate in the same manner as if the control program(s) were stored in the ROM 5. This enables adding control programs and upgrading the version of the control programs with ease.

In the present embodiment, the control I/F 10 is implemented by a MIDI (Musical Instrument Digital Interface) that inputs and outputs MIDI messages, but the control I/F 10 may be implemented by a universal interface such as RS-232C, USB (Universal Serial Bus), or IEEE1394. In this case, data other than MIDI message data may be transmitted and received simultaneously via the control I/F 10.

As mentioned above, the communication I/F 11 is connected to the communication network 201 which may be a LAN (Local Area Network), the Internet, a telephone line, or the like, for connection to the server 202 via the communication network 201. When one or more of the above programs and various parameters are not stored in the external storage device 9, the communication I/F 11 is used to download such program(s) and parameters from the server 202. The automatic accompaniment apparatus 1 as a client transmits a command or commands for downloading one or more programs and parameters to the server 202 via the communication I/F 11 and the communication network 201. In response to the command(s), the server 202 distributes the requested program(s) and parameters to the automatic accompaniment apparatus 1 via the communication network 201, and the automatic accompaniment apparatus 1 receives the program(s) and parameters via the communication I/F 11 and stores them in the external storage device 9, thus completing the download.

Although in the present embodiment, the automatic accompaniment apparatus 1 is constructed on a dedicated apparatus, the present invention is not limited to this, but the automatic accompaniment apparatus 1 may be constructed on a general-purpose personal computer by running an automatic accompaniment program thereon.

Figure 2:
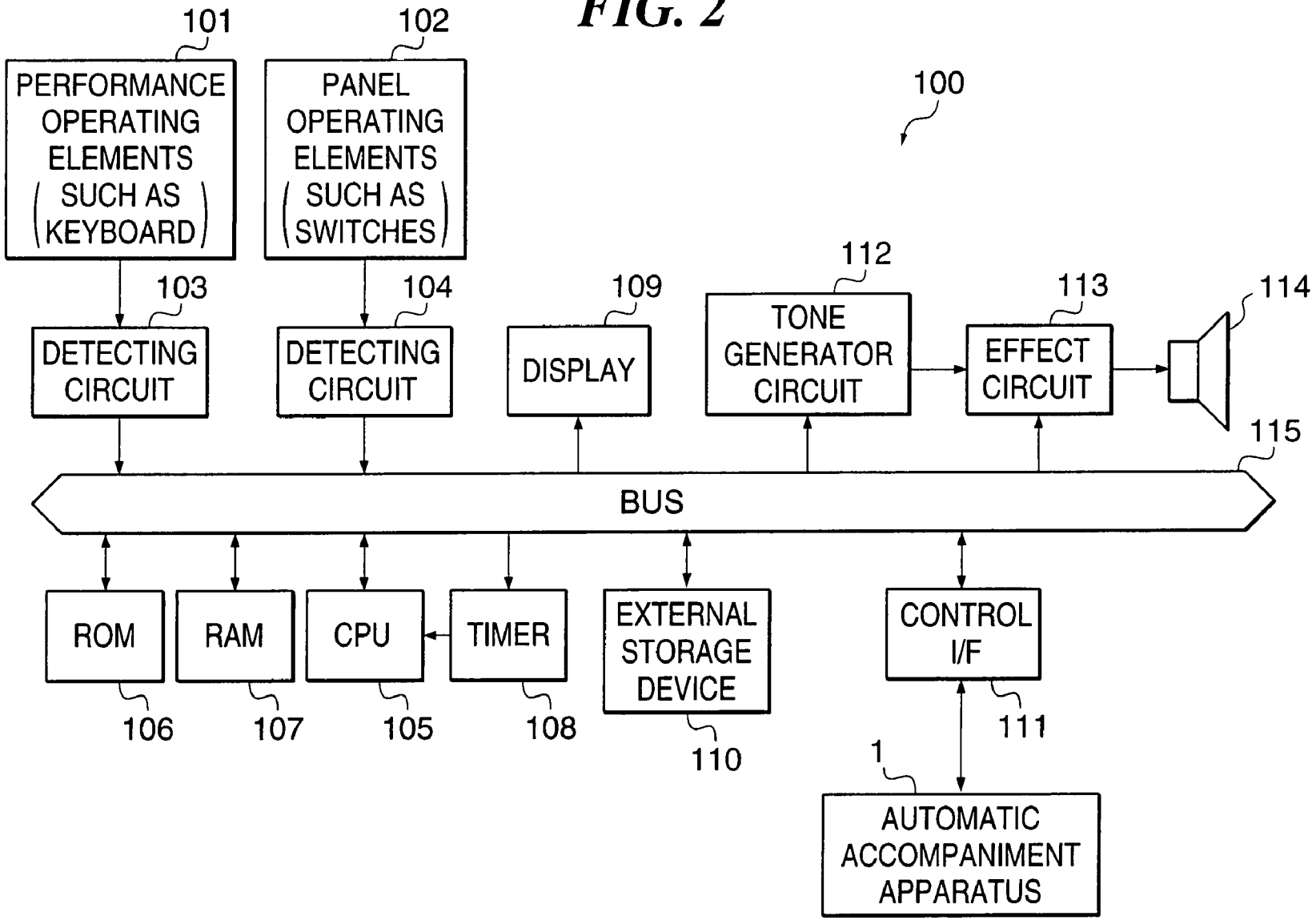
FIG. 2 is a block diagram schematically showing the construction of an external electronic musical instrument appearing in FIG. 1.

FIG. 2 is a block diagram schematically showing the construction of the external electronic musical instrument 100.

As shown in FIG. 2, the external electronic musical instrument 100 is comprised of performance operating elements 101 including a keyboard for inputting pitch information; panel operating elements 102 including a plurality of switches, a numeric keypad, etc. for inputting various information; a detecting circuit 103 for detecting operative states of the performance operating elements 101; a detecting circuit 104 for detecting operative states of the panel operating elements 102; a CPU 105 that controls the entire apparatus; a ROM 106 that stores control programs to be executed by the CPU 105, various table data, etc.; a RAM 107 for temporarily storing accompaniment information, various input information, computation results, etc.; a timer 108 that measures an interrupt time for timer interrupt processing and various kinds of time; a display 109 comprised of an LCD, LEDs, etc., for displaying various information; an external storage device 110 that stores various application programs including control programs, various musical composition data, and various other data; a control I/F 111 that inputs control information from external devices and outputs control information to external devices; a tone generator circuit 112 that converts performance information input by the performance operating elements 101, generated accompaniment information, and so forth into musical tone signals; an effect circuit 113 that applies various effects to musical tone signals from the tone generator circuit 112; and a sound system 114 that converts musical tone signals from the effect circuit 113 into sounds and is comprised of a DAC (digital-to-analog converter), an amplifier, a speaker, etc.

The above component elements 103 to 113 are connected to one another via a bus 115. The timer 108 is connected to the CPU 105, the automatic accompaniment apparatus 1 to the control I/F 111, the effect circuit 113 to the tone generator circuit 112, and the sound system 114 to the effect circuit 113, respectively.

The external storage device 110 may be implemented, for example, by an FDD, an HDD, a CD-ROM drive, or an MO drive. The external storage device 110 may store the control programs to be executed by the CPU 105 as mentioned above. If one or more of the control programs are not stored in the ROM 106, the control program(s) may be stored in the external storage device 110, and by reading out the control program(s) from the external storage device 110 and storing the same in the RAM 107, the CPU 105 can operate in the same manner as if the control program(s) were stored in the ROM 106. This enables adding control programs and upgrading the version of the control programs with ease.

Although in the present embodiment, the control I/F 111 is implemented by a MIDI as is the case with the above-mentioned control I/F 10, the present invention is not limited to this, but the control I/F 111 may be implemented by a universal interface such as RS-232C, USB, or IEEE1394. In this case, data other than MIDI message data may be transmitted and received simultaneously via the control I/F 111.

Although in the present embodiment, the external electronic musical instrument 100 is a keyboard musical instrument type, the present invention is not limited to this, but the external electronic musical instrument 100 may be implemented by a stringed instrument type, a wind instrument type, a percussion instrument type, or the like.

Also, the external electronic musical instrument 100 may be constructed on a dedicated apparatus other than an electronic musical instrument, which is comprised of the minimum elements that can practice the present invention. Alternatively, the external electronic musical instrument 100 may be constructed on a general-purpose personal computer.

Further, although in the present embodiment, the automatic accompaniment apparatus 1 is not provided with a tone generator system (a tone generator circuit, an effect circuit, and a sound system) that generates musical tone signals to sound musical tones, it is to be understood that the automatic accompaniment apparatus 1 may be provided with such a tone generator system. Also, although in the present embodiment, the external electronic musical instrument 100 is not provided with a communication I/F, it is to be understood that an electronic musical instrument provided with a communication I/F may be connected as an external electronic musical instrument to the control I/F 10 of the automatic accompaniment apparatus 1.

Referring to FIGS. 3 to 7, a detailed description will now be given of control processing to be carried out by the automatic accompaniment apparatus 1 constructed as described above.

Figure 3:
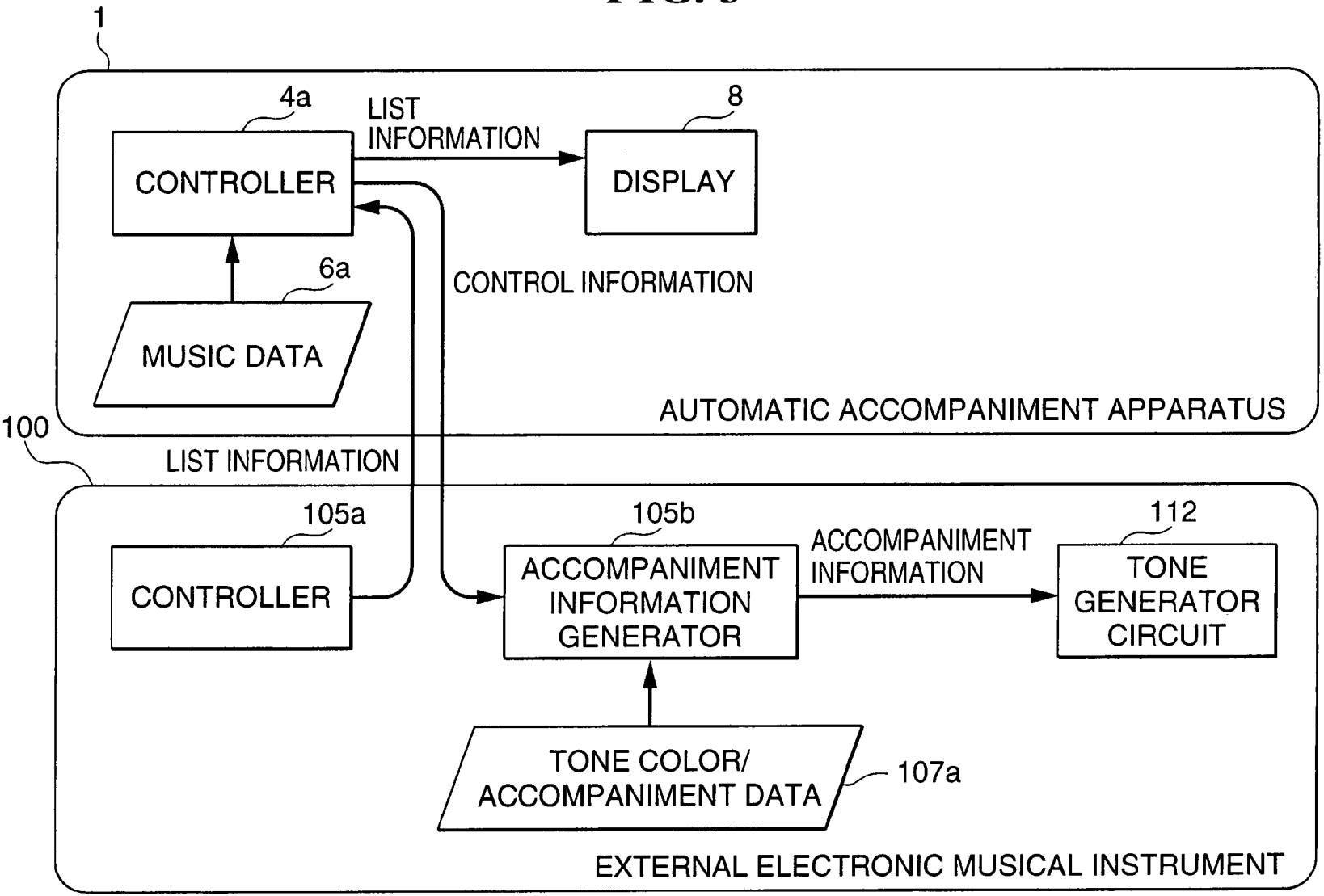
FIG. 3 is a block diagram showing the control system configurations of the automatic accompaniment apparatus in FIG. 1 and the external electronic musical instrument in FIG. 2.

FIG. 3 is a block diagram showing the control system configurations of the automatic accompaniment apparatus 1 and the external electronic musical instrument 100. It should be noted that in FIG. 3, there are shown only the configurations of elements and parts needed to explain the control processing carried out by the automatic accompaniment apparatus 1. Therefore, for example, in FIG. 3, an accompaniment information generator is not provided in the automatic accompaniment apparatus 1, this does not mean that the automatic accompaniment apparatus 1 is not provided with the accompaniment information generator.

A description will be given of which control elements correspond to which elements of hardware in FIGS. 1 and 3 prior to description of the control processing carried out by the control elements in FIG. 3.

A controller 4*a* corresponds to the CPU 4, and music data 6*a* corresponds to data that is designated by a user from among a plurality of music data (such as music data for generating the melody of a piece of music) stored in the external storage device 9 and read out therefrom and stored in a music data storage area, not shown, reserved at a predetermined location in the RAM 6. It should be noted that the display 8 is the same as the display 8 appearing in FIG. 1.

A controller 105*a* and an accompaniment information generator 105*b* correspond to the CPU 105, and tone color/accompaniment data 107*a* corresponds to tone color/accompaniment data that is read out in association with control information transmitted from the controller 4*a* from among a plurality of tone color/accompaniment data stored in the external storage device 110 and then stored in a tone color/accompaniment data storage area, not shown, reserved at a predetermined location in the RAM 107 as described later. It should be noted that the tone generator circuit 112 is the same as the tone generator circuit 112 appearing in FIG. 2.

Figure 4:
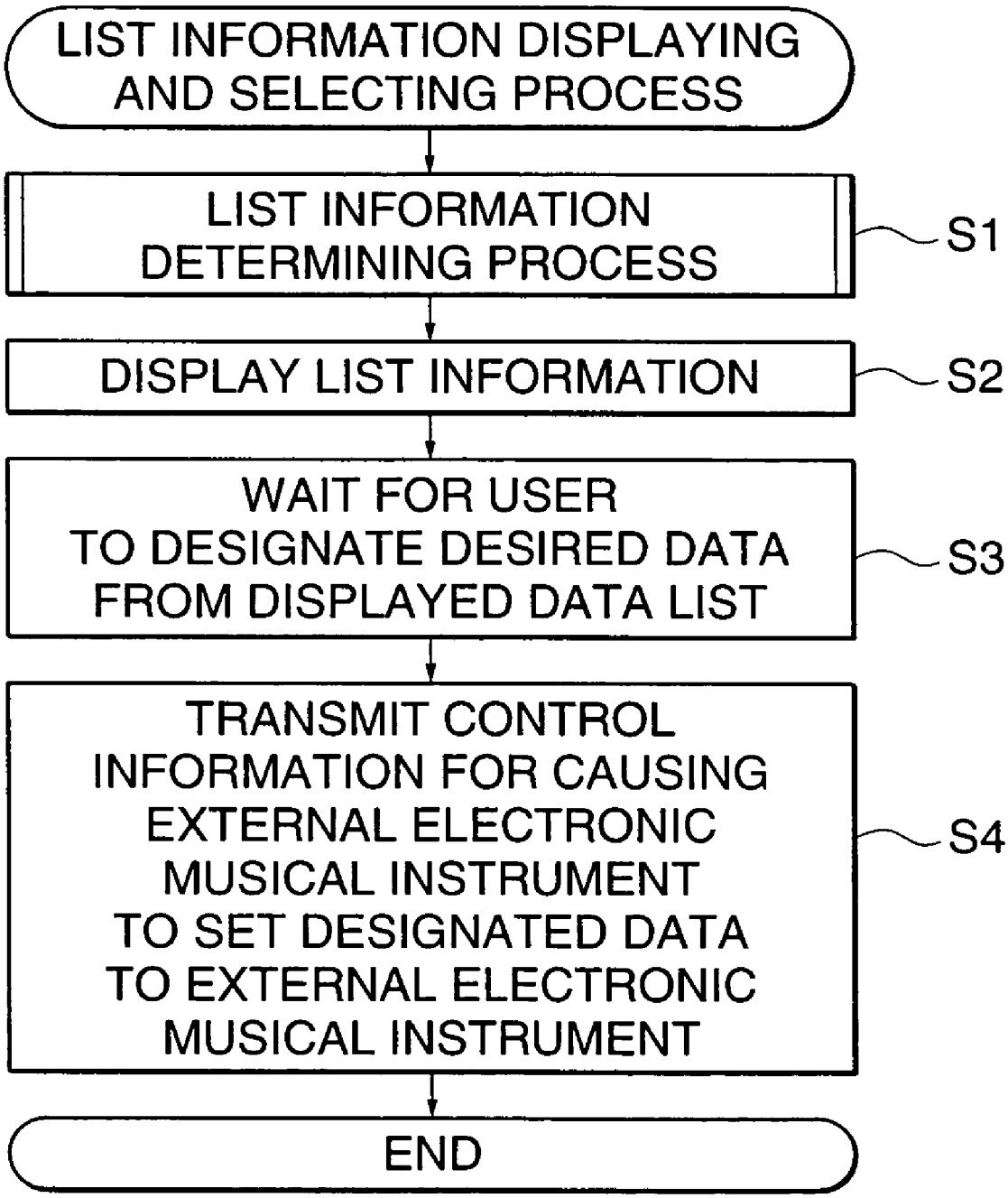
FIG. 4 is a flow chart showing the procedure of a list information displaying and selecting process carried out by a controller of the automatic accompaniment apparatus appearing in FIG. 3.

FIG. 4 is a flow chart showing the procedure of a list information displaying and selecting process to be carried out by the controller 4*a* appearing in FIG. 3. The list information displaying and selecting process is started when the user gives an instruction for displaying list information on tone color data and accompaniment data stored in advance in the external electronic musical instrument 100.

As shown in FIG. 4, a list information determination process subroutine is executed first (step S1).

Figure 5:
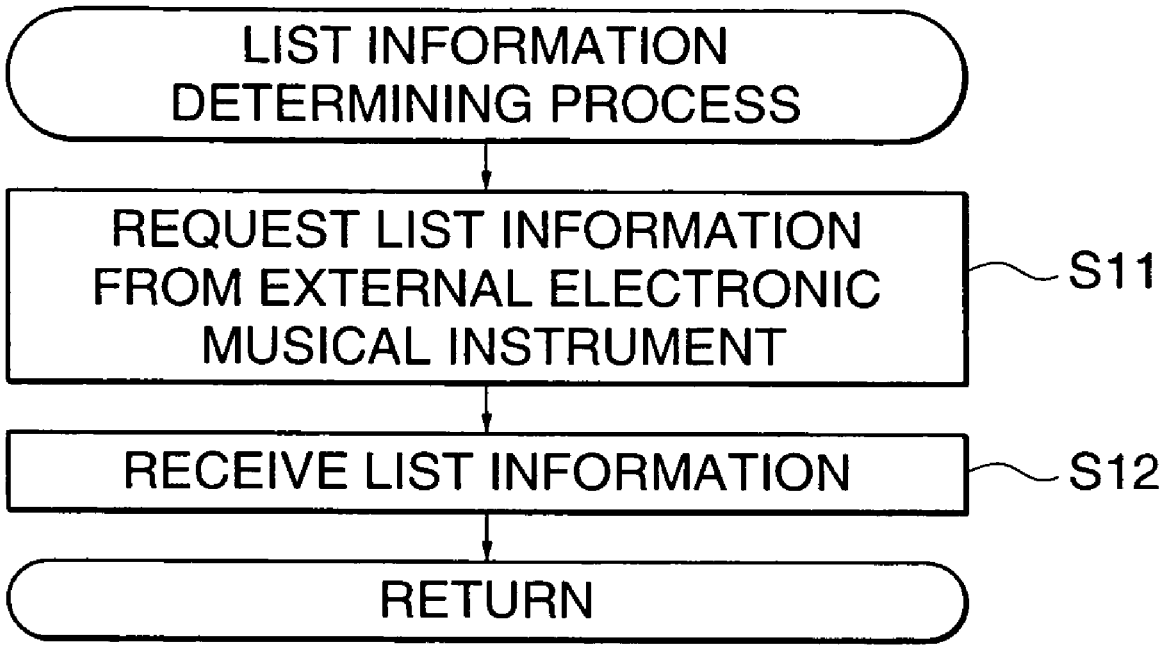
FIG. 5 is a flow chart showing in detail the procedure of a list information determining process subroutine in FIG. 4.

FIG. 5 is a flow chart showing in detail the procedure of the list information determination process subroutine.

As shown in FIG. 5, first, a MIDI system exclusive message is transmitted to the external electronic musical instrument 100 via the control I/F 10 (step S11). The system exclusive message includes a message that requests transmission of list information on tone color data and accompaniment data stored in advance in (the ROM 106 or the external storage device 110 of) the external electronic musical instrument 100 to the automatic accompaniment apparatus 1.

Upon receiving the message, (the controller 105*a* of) the external electronic musical instrument 100 transmits list information on tone color data and accompaniment data stored in advance in the external electronic musical instrument 100 to the automatic accompaniment apparatus 1 via the control I/F 111. The controller 4*a* of the automatic accompaniment apparatus 1 receives the list information on tone color data and accompaniment data via the control I/F 10 (step S12). The received list information on tone color data and accompaniment data is stored in a list information storage area, not shown, reserved at a predetermined location, for example, in the RAM 6.

Referring again to FIG. 4, the controller 4*a* displays the received list information on tone color data and accompaniment data on the display 8 (step S2).

FIGS. 6A and 6B are diagrams showing examples of views of list information on tone color data acquired from two models of external electronic musical instruments that differ in the number of tone color data they hold, in which FIG. 6A shows an example of view of list information acquired from the model that holds only a small number (e.g. 128 kinds) of tone color data, and FIG. 6B shows an example of view of list information acquired from the model that holds a large number of (e.g. 384 kinds) of tone color data. Although in the illustrated example, each piece of tone color data is designated by a combination of a bank select number and a program change number, but the method of designating tone color data is not limited to this. Also, in displaying tone color data, only a tone color name may be displayed without displaying information that designates tone color data (a bank select number and a program change number).

FIGS. 7A and 7B are diagrams showing examples of views of list information on accompaniment data acquired from two models of external electronic musical instruments that differ in the number of accompaniment data they hold, in which FIG. 7A shows an example of view of list information acquired from the model that holds only a small number (e.g. 4 kinds) of accompaniment data, and FIG. 7B shows an example of view of list information acquired from the model that holds a large number of accompaniment data.

Although in the illustrated example, each piece of accompaniment data is designated by a combination of a category number and a style number, but the method of designating accompaniment data is not limited to this. Also, in displaying accompaniment data, only an accompaniment style name may be displayed without displaying information that designates accompaniment data (a category number and a style number).

Although in FIGS. 6A, 6B, 7A, and 7B, acquired list information on tone color data and list information on accompaniment data are displayed separately, the present invention is not limited to this, but they may be displayed at a time on the same screen. In the case where they cannot be displayed at a time, only a part that can be displayed may be displayed. In this case, the user operates a scroll operating element, not shown, of the panel operating elements 2 to display a part hidden from view.

Referring to FIG. 4 again, it is awaited that the user designates desired data (at least either of tone color data and accompaniment data) using a cursor switch, not shown, of the panel operating elements 2 from among the displayed list of tone color data and accompaniment data (step S3). When the user designates desired data, control information for controlling (the accompaniment information generator 105*b* of) the external electronic musical instrument 100 to set the designated data as the tone color/accompaniment data 107*a* is transmitted to the external electronic musical instrument 100 (step S4).

When the user gives an instruction for starting generation of accompaniment information after the tone color/accompaniment data 107*a* has been set in the above described manner, the controller 4*a* of the automatic accompaniment apparatus 1 shifts the value of a readout pointer, not shown, which indicates a readout position of the music data 6*a*, one by one each time a predetermined time period has elapsed, and in the case where there is an event at the readout position of the music data 6*a* indicated by the readout pointer, the controller 4*a* reads out the event, generates control information based on the readout event, and transmits the same to the accompaniment information generator 105*b* of the external electronic musical instrument 100.

The accompaniment information generator 105*b* generates accompaniment information based on the control information and tone color/accompaniment data 107*a* transmitted from the controller 4*a*.

As described above, according to the present embodiment, list information on a plurality of tone color data and a plurality of accompaniment data stored in advance in an external electronic musical instrument connected to the apparatus is acquired, and desired tone color data and accompaniment data are selected from among the acquired list information and set in the external electronic musical instrument. As a result, it is possible to set tone color data and accompaniment data adapted to the electronic musical instrument.

Although in the present embodiment, tone color data and accompaniment data are always selected and set at the same time, the present invention is not limited to this, but only either of them may be selected and set. In this case, default data is set instead of data that has not been selected. This also applies to a second embodiment described next.

A description will now be given of an automatic accompaniment apparatus 1' according to the second embodiment of the present invention.

The automatic accompaniment apparatus 1' according to the present embodiment differs from the automatic accompaniment apparatus 1 according to the first embodiment only in the procedures of control processing, and hence the same hardware as that of the automatic accompaniment apparatus 1, i.e. the hardware in FIG. 1 is used as it is. For the external electronic musical instrument 100, the hardware in FIG. 2 is used as it is.

Figure 8:
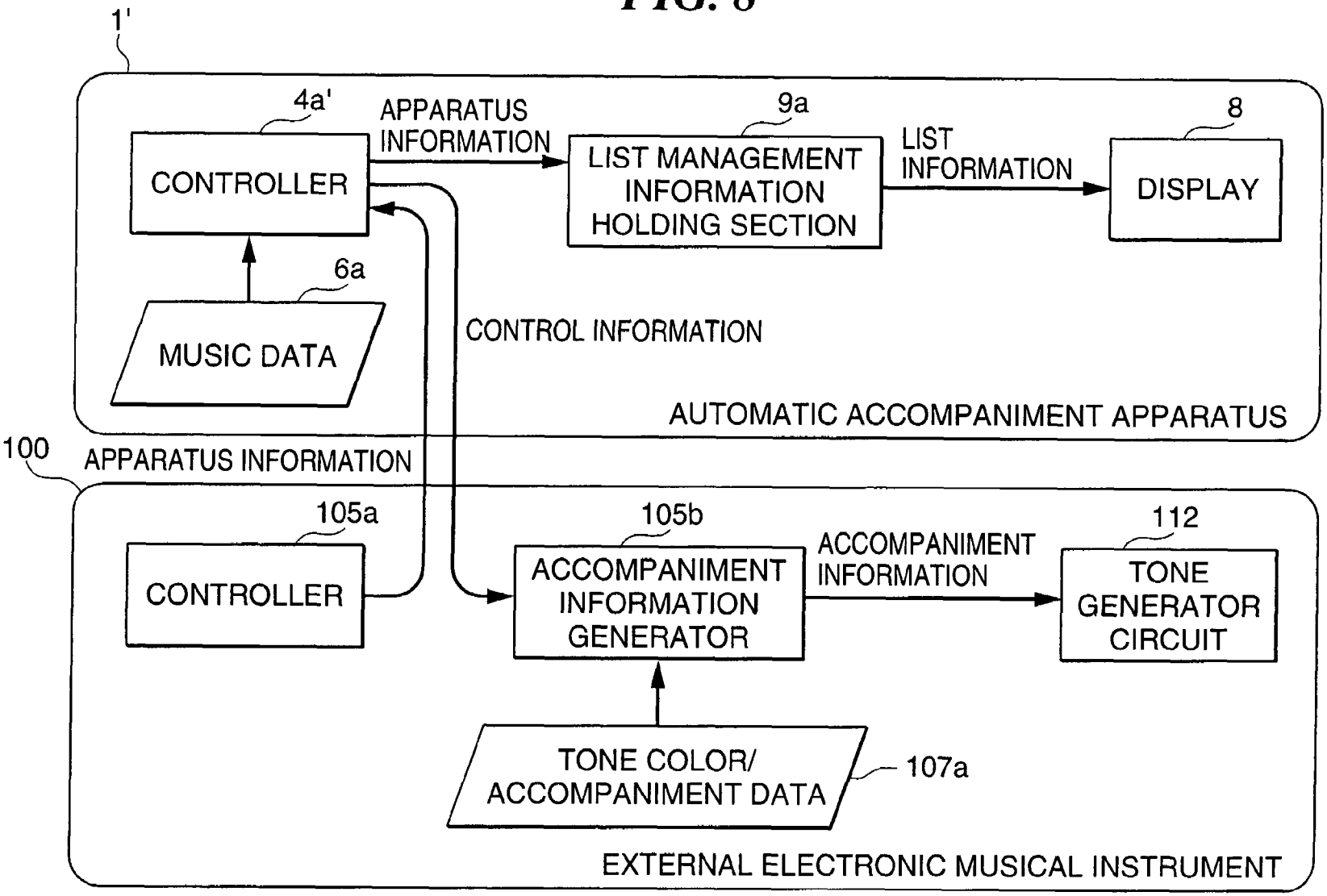
FIG. 8 is a block diagram showing the control system configurations of an automatic accompaniment apparatus according to a second embodiment of the present invention and the external electronic musical instrument.

FIG. 8 is a block diagram showing the control system configurations of the automatic accompaniment apparatus 1' according to the present embodiment and the external electronic musical instrument 100. In FIG. 8, elements corresponding to those appearing in FIG. 3 are denoted by the same reference numerals, and description thereof is omitted.

Figure 9:
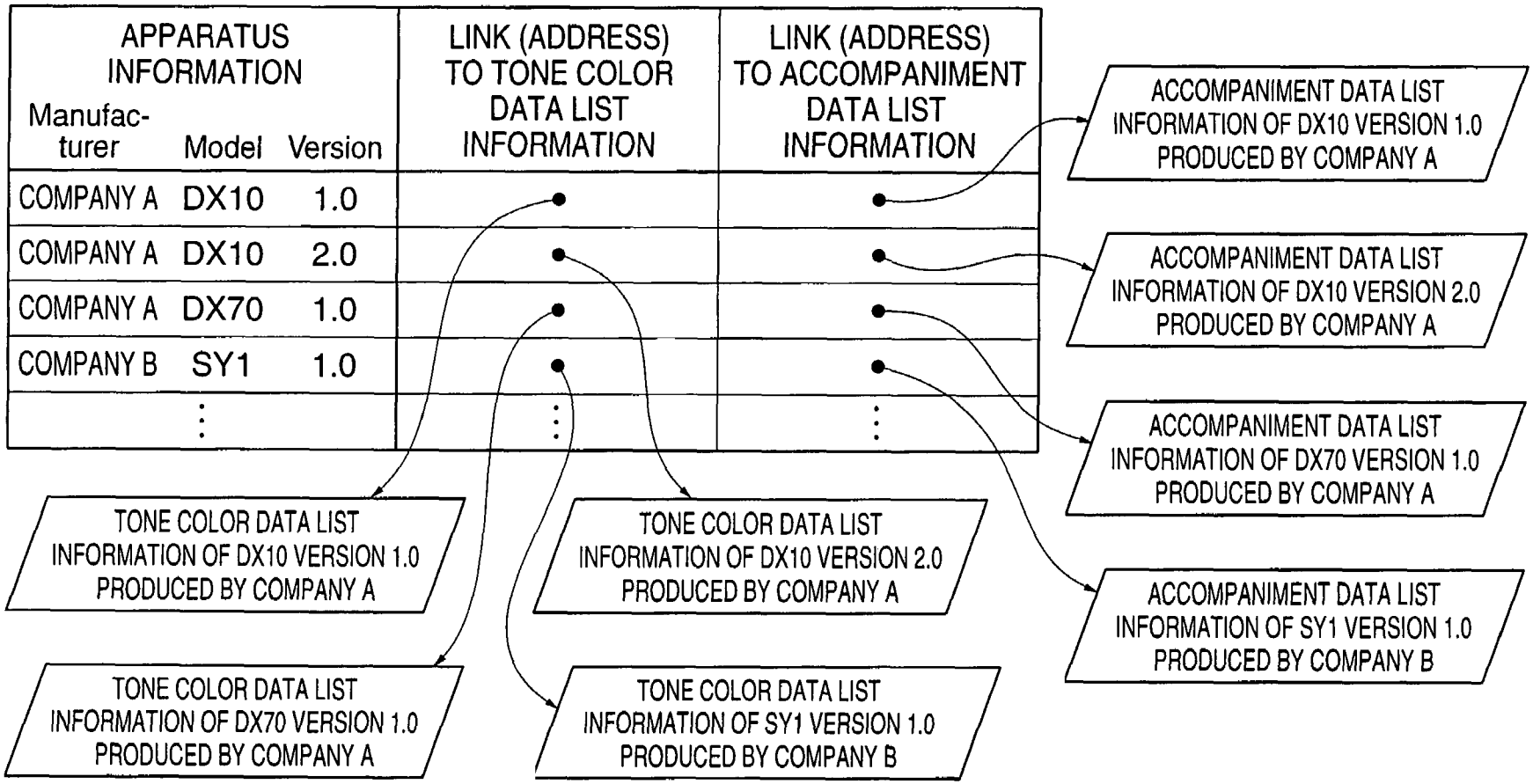
FIG. 9 is a diagram showing an example of list management information held in a list management information holding section of the automatic accompaniment apparatus appearing in FIG. 8.

As shown in FIG. 8, the automatic accompaniment apparatus 1' holds list management information, for example, as shown in FIG. 9 in a list management information holding section 9*a* constructed on the external storage device 9 appearing in FIG. 1.

In the list management information in FIG. 9, information on links (such as addresses) to respective pieces of list information on tone color data and accompaniment data held in advance by each of apparatuses (external electronic musical instruments) is provided in association with corresponding apparatus information, and a set of the respective pieces of list information on tone color data and accompaniment data for the respective apparatuses are stored in different areas of the external storage device 9.

With such list management information being held, once apparatus information on the external electronic musical instrument 100 connected to the automatic accompaniment apparatus 1' has been found, information on links to respective pieces of list information on tone color data and accompaniment data for the external electronic musical instrument can be found from the apparatus information, and as a result, the linked list information on tone color data and accompaniment data can be acquired.

Therefore, a controller 4*a'* of the automatic accompaniment apparatus 1' requests apparatus information on the external electronic musical instrument 100 from the controller 105*a* of the external electronic musical instrument 100.

Although in the present embodiment, a manufacturer name, a model name, and a version are given as examples of apparatus information, other information may be used insofar as they can identify a model.

Next, a description will be given of a list information displaying and selecting process carried out by the controller 4*a'*.

Figure 10:
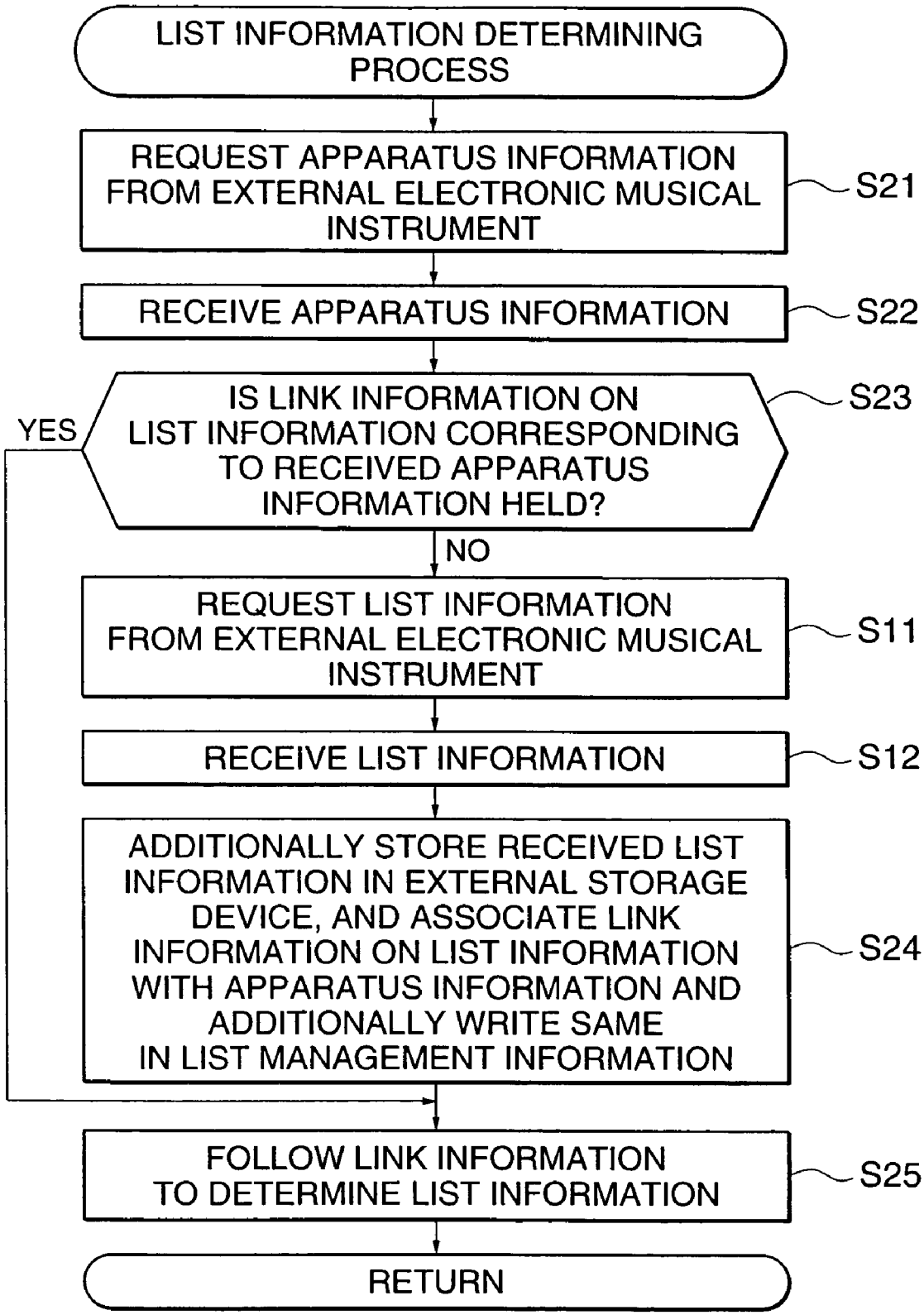
FIG. 10 is a flow chart showing in detail the procedure of a list information determining process subroutine carried out by a controller of the automatic accompaniment apparatus appearing in FIG. 8.

The list information displaying and selecting process according to the present embodiment can be realized by changing the list information determining process subroutine (FIG. 5) in the step S1 in FIG. 4 to a list information determining process subroutine of FIG. 10. Therefore, the processing in the steps S2 to S4 except for the step S1 in FIG. 4 is used as it is, and description thereof is omitted.

As shown in FIG. 10, first, the controller 4*a'* requests apparatus information from the external electronic musical instrument 100 connected to the automatic accompaniment apparatus 1' (step S21). Specifically, the controller 4*a'* transmits a MIDI device inquire message to the external electronic musical instrument 100 via the control I/F 10. Responsive to this, the external electronic musical instrument 100 transmits apparatus information on itself to the automatic accompaniment apparatus 1' via the control I/F 111.

Next, the controller 4*a'* receives the apparatus information from the external electronic musical instrument 100 (step S22) and determines whether or not the list management information holding section 9*a* holds link information on list management information corresponding to the received apparatus information (step S23).

If, as a result of the determination in the step S23, the list management information holding section 9*a* holds link information on list management information corresponding to the received apparatus information, list information is determined by following the link information (step S25). On the other hand, if the list management information holding section 9*a* does not hold link information on list management information corresponding to the received apparatus information, list information is received from the external electronic musical instrument 100 by carrying out the same processing as in the steps S11 and S12 in FIG. 5. In place of the processing in the steps S11 and S12 in FIG. 5, however, list information may be requested from the server 202 via the communication I/F 11 and the communication network 201, and the list information transmitted from the server 202 in response to the request may be received via the communication I/F 11 and the communication network 201.

Next, in a step S24, the received list information is additionally stored in the external storage device 9, and the link information on the list information is associated with the apparatus information and additionally written in the list management information in the list management information holding section 9*a* (step S24). The process then proceeds to the step S25 wherein list information is determined. Since the received list information and link information associated therewith are stored in the external storage device 9 that is a nonvolatile memory, it is only necessary to read out the list information stored in the external storage device 9 without executing the steps S11 and S12 again when the same external electronic musical instrument is connected to the automatic accompaniment apparatus 1' next time, thereby ensuring quick use of list information. It should be noted that the nonvolatile memory is not limited to the external storage device 9, but may be, for example, a flash memory or a battery backed-up RAM insofar as it is nonvolatile when power supply to the automatic accompaniment apparatus 1' is turned off.

The list information determined in the step S25 is transmitted to the display 8 as shown in FIG. 8 and displayed on the display 8.

The subsequent processing is the same as the corresponding processing in FIG. 4, and therefore description thereof is omitted.

As described above, according to the present embodiment, list information on a plurality of tone color data and accompaniment data stored beforehand in each of a plurality of electronic musical instruments is held in association with corresponding apparatus information, and on the other hand, apparatus information on an external electronic musical instrument connected to the automatic accompaniment apparatus is acquired, so that when the user selects desired tone color and accompaniment from list information corresponding to the acquired apparatus information, tone color data and accompaniment data corresponding to the selected tone color and accompaniment, respectively, are set in the external electronic musical instrument, and as a result, the tone color data and the accompaniment data adapted to the external electronic musical instrument can be set.

Figure 11:
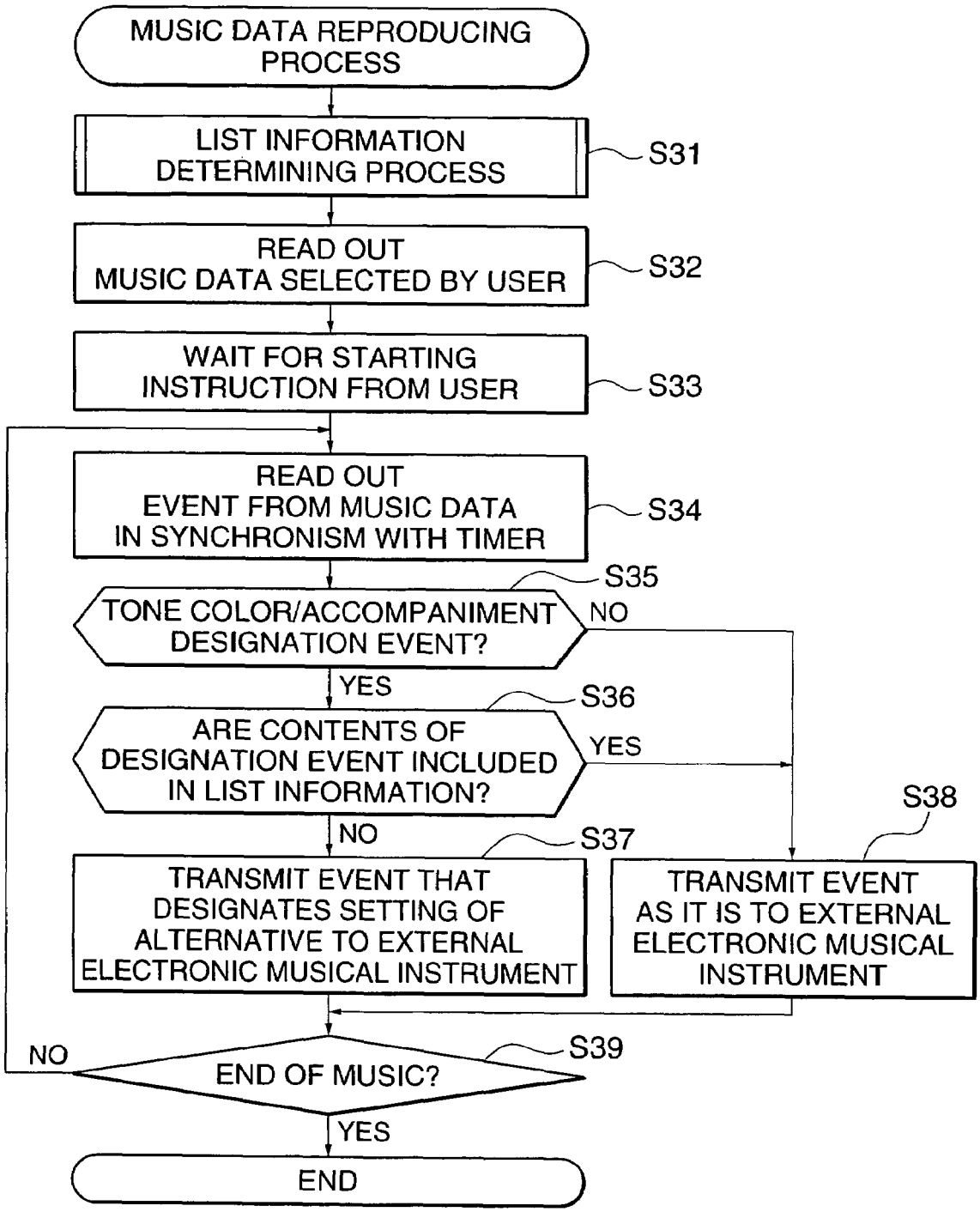
FIG. 11 is a flow chart showing the procedure of a music data reproducing process carried out by the controller of the automatic accompaniment apparatus appearing in FIG. 8.

FIG. 11 is a flow chart showing a music data reproducing process carried out by the controller 4*a'* of the automatic accompaniment apparatus 1'. The music data reproducing process is started when the user attempts to start an operation for reproducing music data. A description will be given of the outline of the music data reproducing process prior to detailed description thereof.

The music data reproducing process is such that, in the case where a tone color designation event in which tone color data in the external electronic musical instrument 100 is designated (set) and accompaniment designation event in which accompaniment data in the external electronic musical instrument 100 is designated (set) are reproduced during reproduction of music data selected by the user, and tone color data and accompaniment data corresponding to the tone color designation event and the accompaniment designation event, respectively, are not stored in advance in the external electronic musical instrument 100, tone color data and accompaniment data as alternatives to the corresponding tone color data and accompaniment data are set in the external electronic musical instrument 100.

As shown in FIG. 11, first, list information is determined by carrying out the list information determining process subroutine in FIG. 10 (step S31). It should be noted that in place of the list information determining process subroutine in FIG. 10, the list information determining process subroutine in FIG. 5 used in the first embodiment may be executed in the step S31. Also, the list information determining process subroutine should not necessarily be executed in the music data reproducing process, but may be executed when power supply to the automatic accompaniment apparatus 1' is turned on, or when the external electronic musical instrument 100 is detected.

Next, when the user selects any music data from among a plurality of music data stored in the external storage device 9 using the panel operating elements 2 appearing in FIG. 1, the selected music data is read out and stored in a music data storage area (step S32), reserved at a predetermined location in the RAM 6. The above-mentioned music data 6*a* in the automatic accompaniment apparatus 1' in FIG. 8 corresponds to the readout music data.

It is then awaited that the user gives an instruction for starting reproduction of music using, for example, a start switch, not shown, of the panel operating elements 2 (step S33). When the user gives an instruction for starting reproduction of music, an event included in the music data 6*a* is read out in synchronism with measurement of a predetermined time period by the timer 7 appearing in FIG. 1 (step S34).

The following processing is carried out in accordance with the contents of the event read out in the step S34:

(1) When the readout event≠tone color/accompaniment designation event: the readout event is transmitted as it is to the external electronic musical instrument 100 (step S38).

(2) When the readout event=tone color/accompaniment designation event and the contents of the designation event are included in list information: the readout event is transmitted as it is to the external electronic musical instrument 100 (step S38).

(3) When the readout event=tone color/accompaniment designation event and the contents of the designation event are not included in list information: an event that designates setting of an alternative is transmitted to the external electronic musical instrument 100 (step S37).

Here, examples of an event that is not a tone color/accompaniment designation event include a theme part note-on/off event and a tempo event. Also, examples of an event that designates setting of an alternative include an event that, in the case where the external electronic musical instrument 100 storing accompaniment data in FIG. 7A is connected to the automatic accompaniment apparatus 1' and an event designating Cha Cha Cha accompaniment data not stored in the external electronic musical instrument 100 (category number: 1 and style number: 2) has been read out from the music data 6*a*, designates Bossanova accompaniment data with the same category number (category number: 1 and style number: 1) as an alternative of the readout event.

The processing in the steps S34 to S38 is then repeated until the final event in the music data 6*a* is read out (step S39).

As described above, according to the present embodiment, in the case where a tone color/accompaniment designation event is read out, and tone color/accompaniment data corresponding to the readout tone color/accompaniment designation event is not stored in an external electronic musical instrument connected to the automatic accompaniment apparatus, a tone color/accompaniment designation event that designates tone color/accompaniment data stored in the external electronic musical instrument and similar to tone color/accompaniment data that corresponds to the readout tone color/accompaniment designation event is transmitted as an alternative event to the external electronic musical instrument. As a result, even when tone color/accompaniment data that is not stored in the external electronic musical instrument is desired to be set, tone color/accompaniment data close thereto can be set in the external electronic musical instrument without errors.

Although in the above described embodiments, list information is presented to the user by displaying it on the display, the present invention is not limited to this, but alternatively, list information may be read aloud by a voice, or read aloud by a voice and displayed at the same time.

Further, although in the above described embodiments, information exchanged between the automatic accompaniment apparatus 1 or 1' and the external electronic musical instrument 100 is mainly in the data format of MIDI messages, the present invention is not limited to this.

It is to be understood that the object of the present invention may also be accomplished by supplying a system or an apparatus with a storage medium in which a program code of software, which realizes the functions of any of the above described embodiments is stored, and causing a computer (or CPU or MPU) of the system or apparatus to read out and execute the program code stored in the storage medium.

In this case, the program code itself read from the storage medium realizes the novel functions of the present invention, and hence the program code and a storage medium on which the program code is stored constitute the present invention.

Examples of the storage medium for supplying the program code include a flexible disk, a hard disk, a magneto-optical disk, an optical disk such as a CD-ROM, a CD-R, a CD-RW, a DVD-ROM, a DVD-RAM, a DVD-RW, or a DVD+RW, a magnetic tape, a nonvolatile memory card, and a ROM. Alternatively, the program code may be downloaded from a server computer via a communication network.

Further, it is to be understood that the functions of any of the above described embodiments may be accomplished not only by executing a program code read out by a computer, but also by causing an OS (operating system) or the like which operates on the computer to perform a part or all of the actual operations based on instructions of the program code.

Further, it is to be understood that the functions of any of the above described embodiments may be accomplished by writing a program code read out from the storage medium into a memory provided in an expansion board inserted into a computer or a memory provided in an expansion unit connected to the computer and then causing a CPU or the like provided in the expansion board or the expansion unit to perform a part or all of the actual operations based on instructions of the program code.

What is claimed is:

1. An automatic accompaniment apparatus comprising:

a connecting device that connects to an external electronic musical instrument that stores in advance at least one of a plurality of tone color data and a plurality of accompaniment data and generates accompaniment information based on at least one of tone color data and accompaniment data selected from the stored at least one of the plurality of tone color data and the plurality of accompaniment data, and carries out transmission and reception of information to and from the external electronic musical instrument;

a list information acquiring device that acquires list information on the at least one of tone color data and accompaniment data stored in the external electronic musical instrument via said connecting device;

a presenting device that presents the list information acquired by said list information acquiring device to a user; and a transmitting device that transmits control information for causing the external electronic musical instrument to set at least one of tone color data and accompaniment data selected by the user from the list information presented by said presenting device to the external electronic musical instrument via said connecting device.

2. An automatic accompaniment apparatus comprising:

a storage device that stores sets of list information, each set of which is concerned with at least one of a plurality of tone color data and a plurality of accompaniment data stored in advance in a corresponding one of a plurality of electronic musical instruments, so as to correspond to respective ones of the electronic musical instruments;

a connecting device that connects to an external electronic musical instrument that stores in advance at least one of a plurality of tone color data and a plurality of accompaniment data and generates accompaniment information based on at least one of tone color data and accompaniment data selected from the stored at least one of the plurality of tone color data and the plurality of accompaniment data, and carries out transmission and reception of information to and from the external electronic musical instrument;

an apparatus information acquiring device that acquires apparatus information on the external electronic musical instrument via said connecting device;

a presenting device that reads out list information corresponding to the apparatus information acquired by said apparatus information acquiring device from said storage device and presents the list information to a user; and a transmitting device that transmits control information for causing the external electronic musical instrument to set at least one of tone color data and accompaniment data selected by the user from the list information presented by said presenting device to the external electronic musical instrument via said connecting device.

3. An automatic accompaniment apparatus according to claim 2, further comprising a list information acquiring device operable when the list information corresponding to the apparatus information acquired by said apparatus information acquiring device is not stored in said storage device, to acquire the list information from outside including from the external electronic musical instrument.

4. An automatic accompaniment apparatus according to claim 3, wherein said storage device comprises a nonvolatile storage device and stores the list information acquired by said list information acquiring device.

5. An automatic accompaniment apparatus comprising:

a reproducing device that reproduces music data including at least one of tone color designation data and accompaniment designation data;

a connecting device that connects to an external electronic musical instrument that stores in advance at least one of a plurality of tone color data and a plurality of accompaniment data and generates accompaniment information based on at least one of tone color data and accompaniment data selected from the stored at least one of the plurality of tone color data and the plurality of accompaniment data, and carries out transmission and reception of information to and from the external electronic musical instrument;

a list information acquiring device that acquires list information on the at least one of tone color data and accompaniment data stored in the external electronic musical instrument via said connecting device;

a selecting device that automatically selects at least one of tone color data and accompaniment data closest to the at least one of tone color designation data and accompaniment designation data included in the music data reproduced by said reproducing device from the list information acquired by said list information acquiring device;

a transmitting device that transmits control information for causing the external electronic musical instrument to set the at least one of tone color data and accompaniment data selected by said selecting device to the external electronic musical instrument via said connecting device; and a control device that controls the external electronic musical instrument such that accompaniment information on the music data reproduced by said reproducing device is generated based on the set at least one of tone color data and accompaniment data.

6. An automatic accompaniment apparatus comprising:

a reproducing device that reproduces music data including at least one of tone color designation data and accompaniment designation data;

a storage device that stores sets of list information, each set of which is concerned with at least one of a plurality of tone color data and a plurality of accompaniment data stored in advance in a corresponding one of a plurality of electronic musical instruments, so as to correspond to respective ones of the electronic musical instruments;

a connecting device that connects to an external electronic musical instrument that stores in advance at least one of a plurality of tone color data and a plurality of accompaniment data and generates accompaniment information based on at least one of tone color data and accompaniment data selected from the stored at least one of the plurality of tone color data and the plurality of accompaniment data, and carries out transmission and reception of information to and from the external electronic musical instrument;

an apparatus information acquiring device that acquires apparatus information on the external electronic musical instrument via said connecting device;

a readout device that reads out list information corresponding to the apparatus information acquired by said apparatus information acquiring device from said storage device;

a selecting device that automatically selects at least one of tone color data and accompaniment data closest to the at least one of tone color designation data and accompaniment designation data included in the music data reproduced by said reproducing device from the list information acquired by said list information acquiring device;

a transmitting device that transmits control information for causing the external electronic musical instrument to set the at least one of tone color data and accompaniment data selected by said selecting device to the external electronic musical instrument via said connecting device; and a control device that controls the external electronic musical instrument such that accompaniment information on the music data reproduced by said reproducing device is generated based on the set at least one of tone color data and accompaniment data.

7. An automatic accompaniment apparatus according to claim 6, further comprising a list information acquiring device operable when the list information corresponding to the apparatus information acquired by said apparatus information acquiring device is not stored in said storage device, to acquire the list information from outside including from the external electronic musical instrument.

8. An automatic accompaniment apparatus according to claim 7, wherein said storage device comprises a nonvolatile storage device and stores the list information acquired by said list information acquiring device.

9. A method of controlling an automatic accompaniment apparatus, comprising:

an apparatus information acquiring step of acquiring apparatus information on an external electronic musical instrument that stores in advance at least one of a plurality of tone color data and a plurality of accompaniment data and generates accompaniment information based on at least one of tone color data and accompaniment data selected from the stored at least one of the plurality of tone color data and the plurality of accompaniment data via a connecting device that connects to the external electronic musical instrument and carries out transmission and reception of information to and from the external electronic musical instrument;

a presenting step of reading out list information corresponding to the apparatus information acquired in said apparatus information acquiring step from a storage device that stores sets of list information, each set of which is concerned with at least one of a plurality of tone color data and a plurality of accompaniment data stored in advance in a corresponding one of a plurality of electronic musical instruments, so as to correspond to respective ones of the electronic musical instruments, and presenting the list information to a user; and a transmitting step of transmitting control information for causing the external electronic musical instrument to set at least one of tone color data and accompaniment data selected by the user from the list information presented in said presenting step to the external electronic musical instrument via the connecting device.

10. A method of controlling an automatic accompaniment apparatus, comprising:

a reproducing step of reproducing music data including at least one of tone color designation data and accompaniment designation data;

an apparatus information acquiring step of acquiring apparatus information on an external electronic musical instrument that stores in advance at least one of a plurality of tone color data and a plurality of accompaniment data and generates accompaniment information based on at least one of tone color data and accompaniment data selected from the stored at least one of the plurality of tone color data and the plurality of accompaniment data via a connecting device that connects to the external electronic musical instrument and carries out transmission and reception of information to and from the external electronic musical instrument;

a readout step of reading out list information corresponding to the apparatus information acquired in said apparatus information acquiring step from a storage device that stores sets of list information, each set of which is concerned with at least one of a plurality of tone color data and a plurality of accompaniment data stored in advance in a corresponding one of a plurality of electronic musical instruments, so as to correspond to respective ones of the electronic musical instruments;

a selecting step of automatically selecting at least one of tone color data and accompaniment data closest to the at least one of tone color designation data and accompaniment designation data included in the music data reproduced in said reproducing step from the list information read out in said readout step;

a transmitting step of transmitting control information for causing the external electronic musical instrument to set the at least one of tone color data and accompaniment data selected in said selecting step to the external electronic musical instrument via the connecting device; and a control step of controlling the external electronic musical instrument such that accompaniment information on the music data reproduced in said reproducing step is generated based on the set at least one of tone color data and accompaniment data.

11. A program, stored on a computer readable medium, for causing a computer to execute a method of controlling an automatic accompaniment apparatus, comprising:

an apparatus information acquiring module for acquiring apparatus information on an external electronic musical instrument that stores in advance at least one of a plurality of tone color data and a plurality of accompaniment data and generates accompaniment information based on at least one of tone color data and accompaniment data selected from the stored at least one of the plurality of tone color data and the plurality of accompaniment data via a connecting device that connects to the external electronic musical instrument and carries out transmission and reception of information to and from the external electronic musical instrument;

a presenting module for reading out list information corresponding to the apparatus information acquired by said apparatus information acquiring module from a storage device that stores sets of list information, each set of which is concerned with at least one of a plurality of tone color data and a plurality of accompaniment data stored in advance in a corresponding one of a plurality of electronic musical instruments, so as to correspond to respective ones of the electronic musical instruments, and presenting the list information to a user; and a transmitting module for transmitting control information for causing the external electronic musical instrument to set at least one of tone color data and accompaniment data selected by the user from the list information presented by said presenting module to the external electronic musical instrument via the connecting device.

12. A program, stored on a computer readable medium, for causing a computer to execute a method of controlling an automatic accompaniment apparatus, comprising:

a reproducing module for reproducing music data including at least one of tone color designation data and accompaniment designation data;

an apparatus information acquiring module for acquiring apparatus information on an external electronic musical instrument that stores in advance at least one of a plurality of tone color data and a plurality of accompaniment data and generates accompaniment information based on at least one of tone color data and accompaniment data selected from the stored at least one of the plurality of tone color data and the plurality of accompaniment data via a connecting device that connects to the external electronic musical instrument and carries out transmission and reception of information to and from the external electronic musical instrument;

a readout module for reading out list information corresponding to the apparatus information acquired by said apparatus information acquiring module from a storage device that stores sets of list information, each set of which is concerned with at least one of a plurality of tone color data and a plurality of accompaniment data stored in advance in a corresponding one of a plurality of electronic musical instruments, so as to correspond to respective ones of the electronic musical instruments;

a selecting module for automatically selecting at least one of tone color data and accompaniment data closest to the at least one of tone color designation data and accompaniment designation data included in the music data reproduced by said reproducing module from the list information read out by said readout module;

a transmitting module for transmitting control information for causing the external electronic musical instrument to set the at least one of tone color data and accompaniment data selected by said selecting module to the external electronic musical instrument via the connecting device; and a control module for controlling the external electronic musical instrument such that accompaniment information on the music data reproduced by said reproducing module is generated based on the set at least one of tone color data and accompaniment data.

* * * * *